United States Patent [19]

Burri et al.

[11] 4,051,656

[45] Oct. 4, 1977

[54] DRIVE SYSTEM FOR A SPINDLE FRAME

[75] Inventors: Heinz Burri; Richard Burri, both of Winterthur, Switzerland

[73] Assignee: Rieter Machine Works, Ltd., Winterthur, Switzerland

[21] Appl. No.: 722,094

[22] Filed: Sept. 10, 1976

[30] Foreign Application Priority Data

Sept. 12, 1975 Switzerland ..... 11870/75

[51] Int. Cl.[2] ..... D01H 1/24; F16H 7/10

[52] U.S. Cl. ..... 57/105; 74/219; 74/227; 74/228

[58] Field of Search ..... 74/226–228, 74/219–221; 57/104, 105

[56] References Cited

U.S. PATENT DOCUMENTS

| | | | |
|---|---|---|---|
| 2,655,782 | 10/1953 | Cutler | 57/105 |
| 2,689,448 | 9/1954 | Winslow et al. | 57/105 |
| 2,869,317 | 1/1959 | Schurr et al. | 57/105 |
| 2,953,894 | 9/1960 | Stahlecker et al. | 57/105 |
| 3,479,809 | 11/1969 | Herubel | 57/105 |
| 3,603,069 | 9/1971 | Greive | 57/105 |
| 3,753,344 | 8/1973 | Merck | 57/105 |

*Primary Examiner*—John Petrakes

*Attorney, Agent, or Firm*—Kenyon & Kenyon, Reilly, Carr & Chapin

[57] ABSTRACT

The drive system is used for spinning, twisting or false-twisting machines. The spindles are driven by a tangential drive belt which is tensioned between a drive roll and a tensioning roll. The tensioning roll is mounted by a lever to pivot about a fixed axis. In addition, a rotatable axle is mounted about the fixed axis in order to drive additional working elements of the machine. The tangential belt is maintained under constant tension by a biasing means which biases the lever about the fixed axis.

12 Claims, 6 Drawing Figures

Fig. 1
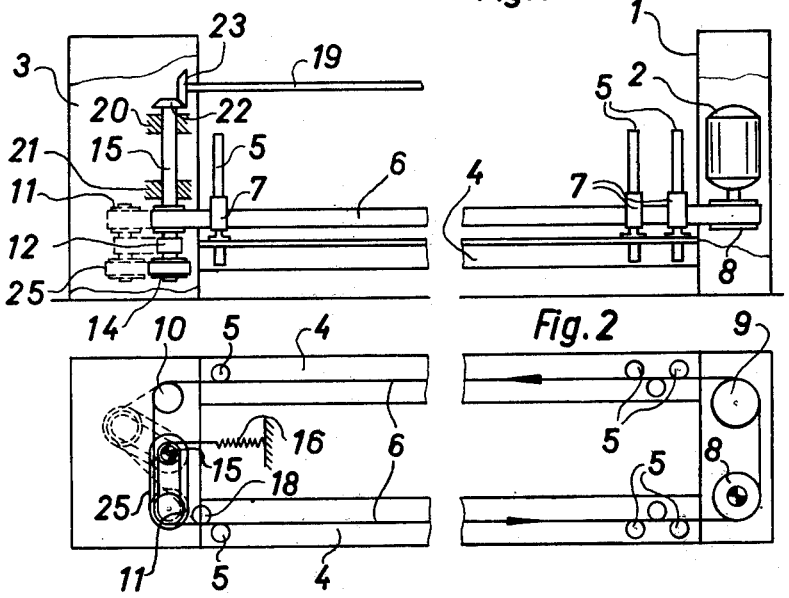
Fig. 2
Fig. 3
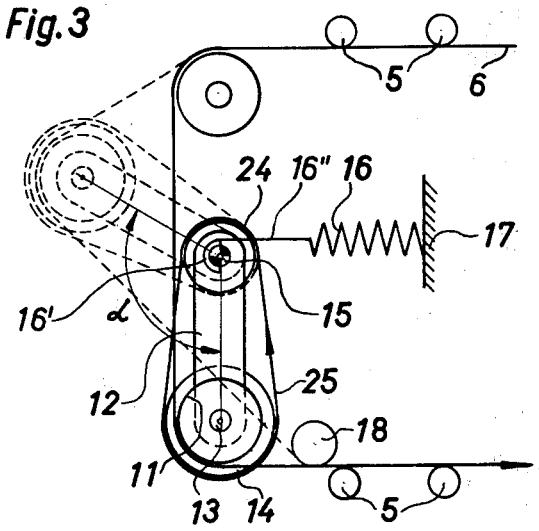

DRIVE SYSTEM FOR A SPINDLE FRAME

This invention relates to a drive system for a spindle frame. More particularly, this invention relates to a drive system for a spinning, twisting or false-twisting machine.

In the following, the term "spinning machine" is understood to designate, for simplicity, spinning machines as well as twisting or false-twisting machines or similar machines.

Heretofore, spinning machines have been known, for example as described in British Pat. No. 1,129,054, to drive a multiplicity of spindles by a tangential drive belt. In such a machine, the drive belt is disposed about a drive shaft and a tensioning roll. In addition, a shaft which is arranged on a fixed axis relative to the machine is driven via a second drive belt by the tensioning roll. In this case, the tensioning roll is slidably supported on a sliding support member and is used for driving a drafting system. As the distance between the axis of the driving tensioning roll and the shaft on the fixed axis is variable due to the movability of the tensioning roll, the second drive belt is tensioned by two spring loaded tensioning rolls which tension both legs of the belt.

However, these known arrangements have a disadvantage in that the tensioning roll of the tangential drive belt effects a translatory movement along a sliding member. Thus, all the problems which are generated by the use of a sliding support occur, such as lubrication problems, the danger of jamming if the sliding surface is contaminated and the like.

A further and very substantial disadvantage of this arrangement also resides in the fact that only a very limited longitudinal elongation of the tangential drive belt is permitted. This is of concern since the drive belt may be up to 40 meters long and moves at high speed. Thus, the full longitudinal elongation of the drive belt must be taken up by the tensioning device of the second belt, the length of which is only about 1 meter. The adaptability of this second belt, however, is very limited according to its length in comparison to the tangential drive belt which is many times longer. The tangential drive belt thus can be elongated only by very small amounts before requiring replacement as the belt cannot be tensioned any further.

A further disadvantage of this arrangement resides in the necessity of providing a second tensioning device for the second belt. This renders the construction of the machine complicated and expensive and demands more maintenance attention.

Accordingly, it is an object of the invention to provide a drive system for a spindle frame in which the elongation of a tangential drive belt can be easily accommodated.

It is another object of the invention to provide a drive system which permits large longitudinal elongations of a tangential belt drive to be taken up.

It is another object of the invention to provide a drive system for a plurality of spindles of a spindle frame which can be used to drive further working elements of a spinning machine.

It is another object of the invention to eliminate the need for any tensioning device in an auxiliary drive means for driving working elements of a spindle frame from a tensioning roll.

Briefly, the invention provides a drive system for a spindle frame having a plurality of spindles arranged in a row. The spindle frame is one which is incorporated in a spinning machine and is useful in spinning, twisting or false-twisting machines.

The drive system comprises a drive roll, a tensioning roll, a tangential drive belt which is tensioned between the drive roll and the tensioning roll for engaging and driving the spindles, and a first axle secured to the tensioning roll for rotation therewith about a first axis. In addition, a second axle is rotatably mounted about a fixed second axis and a lever is journalled on both axles. Also, a means is secured to the lever for biasing the lever to pivot about the fixed second axis in a plane parallel to the tangential drive of the belt. Also, a drive transmitting means is disposed between the two axles for rotatingthe second axle off the first axle while a drive means is interconnected to the second axle for driving additional working elements of the spindle frame.

In one embodiment, the tangential drive belt is used for rotating two rows of spindles while the lever is pivotal relative to the fixed axle over a pivoting angle of from 0° to 135°.

In another embodiment, the spinning machine may be provided with a separate drive system for each one of a plurality of rows of spindles. In such a case, the levers on which the tensioning rolls are mounted may be disposed in mirror-symmetric relation. Alternatively, the drive systems may use a common axle on a fixed axis for mounting the levers of the respective drive systems. In such a case, the drive transmitting means may be disposed between the common axle and only one of the tensioning roll axles in order to drive the additional working elements of the spinning machine.

The means for biasing the lever or levers may be in the form of a spring or a torque bar. For example, the spring may be a tension spring which continously biases the lever against the force of the tangential belt so as to tension the belt at all times. In another embodiment, the biasing means may be in the form of a cylinder and piston unit of pneumatic or hydraulic type.

These and other objects and advantages of the invention will become more apparent from the following detailed description and appended claims taken in conjunction with the accompanying drawings in which:

FIG. 1 illustrates a schematic side view of a drive system of a spinning machine according to the invention;

FIG. 2 illustrates a schematic top view of the drive system shown in FIG. 1;

FIG. 3 illustrates an enlarged detail of the drive system shown in FIG. 2;

Figure 4:
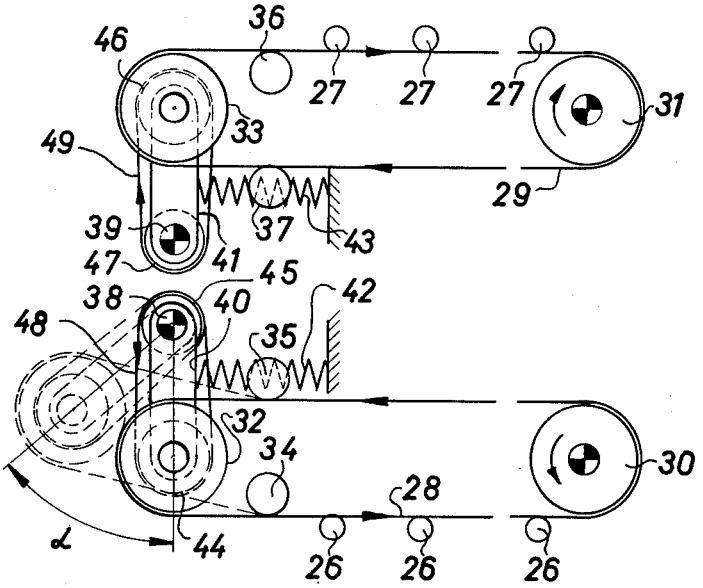
FIG. 4 illustrates a schematic view of a modified drive system for separate drive of each machine side according to the invention.

Referring to FIGS. 1 and 2, a two-sided spinning machine has a frame formed by a drive headstock 1 on which a drive 2 is mounted, a tailstock 3 and two spindle rails 4 which connect the headstock 1 and the tailstock 3. A plurality of textile spindles 5 are mounted in rows on each of the spindle rails 4 and function to impart twist to the yarn or thread, only a few spindles are indicated for simplicity. The spindles 5 are arranged in two rows and are driven by a drive system which employs an endless tangential drive belt 6. As shown, the drive belt 6 engages and drives the spindles 5, via whorls 7, substantially tangentially, the wrapping angle being very small.

The drive system includes a drive roll or pulley 8 which is mounted on the vertically arranged shaft of the drive motor 2 and a plurality of deflecting rolls 9, 10, 11 and 18, of which the roll 11 acts as a tensioning roll. The tangential drive belt 6 is tensioned between the drive roll 8 and tensioning roll 11. A rotational axle 13 (FIG. 3) is rigidly secured at one end to the tensioning roll 11 for rotation with the tensioning roll about a vertical axis. The axle 13 is also journalled in a lever 12 at an intermediate point. The lever 12, in turn, is journalled on a second vertical axle 15 which is rotatably mounted about a fixed axis. The lever 12 allows the tensioning roll to pivot about the axle 15 for tensioning of the tangential drive belt 6. In addition, a means is secured to the lever 12 for biasing the lever 12 to pivot about the axis of the axle 15 in a plane parallel to the drive belt 6. This means is in the form of a tension spring 16, one end of which acts via a flexible force transmitting element 16'' placed around a pivoting segment 16' rigidly connected on the lever 12 and the other end of which is connected with a member 17 fixed relative to the machine frame. The tension spring 16 thus generates a torque momentum which acts clockwise, as viewed, on the lever 12 and maintains the tangential drive belt 6 under constant tension.

In FIGS. 1 and 3, the initial position of the tensioning elements is shown with solid lines whereas the extreme pivoted out position of the tensioning elements is indicated with broken lines. An additional deflecting roll 18 ensures that the tangential drive belt 6 remains in contact with all spindles 5 to be driven even if the tensioning roll 11 is in its pivoted-out position.

The tensioning range of this arrangement, i.e. the maximum elongation of the tangential drive belt 6 which can be taken up by the tensioning roll 11, depends on the pivoting angle $\alpha$ of the lever 12, which angle $\alpha$ in the system described can reach a value of approximately 135°.

Referring to FIGS. 1 to 3, the spinning machine furthermore comprises additional working elements, the drive of which is derived from the tensioning roll 11 of the tangential drive drive belt 6. These working elements consist, e.g. of a shaft 19 which can be part of a drafting arrangement of the spindle machine, which arrangement is not shown in more detail. The shaft 19 can, of course, also drive additional working elements of the spinning machine. Also, the driven working elements need not contain a rotating longitudinal shaft 19. Also, these additional working elements can be of any shape imaginable and can include other elements such as e.g. gear arrangements, belt drive and the like.

In order to drive these additional working elements, the axle 15 is rotatably supported in two support members 20, 21 which are fixed relative to the machine frame and drives the longitudinal shaft 19 via a suitable drive means such as a bevel gear arrangement 22, 23 which interconnects the axle 15 and shaft 19. In order to rotate the axle 15, a drive transmitting means is disposed between the axles 13, 15 for rotating the axle 15 off the axle 13. This drive transmitting means is in the form of a belt pulley 14 which is rigidly connected on the axle 13, a belt pulley 24 which is rigidly connected to the axle 15 in the same plane as the belt pulley 14 and an endless belt 25. Upon rotation of the tensioning roll 11, the belt pulley 14 likewise rotates and the rotational movement of the belt pulley 14 is transmitted to the belt pulley 24 via the endless belt 25. As the distance between the axle 13 of the belt pulley 14 and the pivoting and rotating axle 15 of the belt pulley 24 remains constant at all times, as both are unshiftably connected to the lever 12, no tensioning device is required for tensioning the endless belt 25. If desired, however, a deflection roll (not shown) may be rotatably supported by and unshiftably connected to the lever 12 for deflecting the belt 25. The endless belt 25 can be constructed as flat belt, a v-belt, or as a slippage-free toothed belt. The function of the spinning machine described does not require further explanation.

Referring to FIG. 4, the drive system may be used with a double sided machine, each side of which is provided with an individual tangential drive belt 28, 29. In this system, each machine side is equipped with a row of spindles 26, 27, respectively, which in turn are driven by a tangential drive belt 28, 29 respectively. Each tangential drive belt 28, 29 is tensioned between a drive pulley 30, 31 respectively, which are driven separately or jointly by motors (not shown) and a tensioning roll 30, 33 respectively. Furthermore, in this system two deflecting rolls 34, 35 and 36, 37, repectively, are provided at each respective tangential drive belt 28, 29. These deflecting rolls 34–37 ensure that both legs of the tangential drive belts 28, 29 maintain their correct position while the tensioning rolls 32, 33 pivot. Each tensioning roll 32, 33, in the same manner as in the system described with reference to FIGS. 1 to 3, is mounted on a pivoting axle 38, 39 which is disposed on a fixed axis relative to the machine frame via a pivotable lever 40, 41 and is biased under the influence of a pressure spring 42, 43 along an arc in such a manner that the tangential drive belts 28, 29 are tensioned. Both pivoting axles 38, 39 in this drive system can be used for driving additional working elements of the spinning machine. For this purpose, in this system, as in the system described with reference to FIGS. 1 to 3, a drive transmitting means is provided between the axles of each tensioning roll 32, 33, and each pivoting axle 38, 39 of the levers 40, 41. These latter drive transmitting means consist of belt pulleys 44, 45 and 46, 47 and an endless belt 48, 49 respectively.

This alternative construction shows how to provide a double sided mirror-symmetrically arranged spinning machine with an arrangement of the drive elements according to the invention. As shown in FIG. 4, the tensioning roll of the lower tangential drive belt 28 is shown with solid lines in its initial position and shown with broken lines in a pivoted-out position. The pivoting angle $\alpha$ in this system can reach values of up to about 90°.

A centrally-symmetrical arrangement of the two tangential belt drives instead of the mirror-symmetrical arrangement of course can be considered also.

Figure 5:
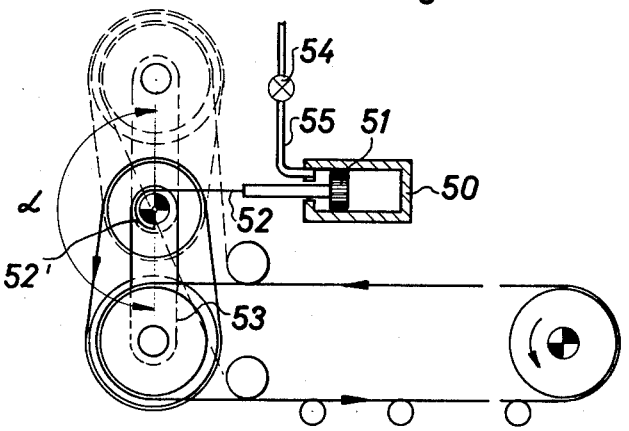
FIG. 5 illustrates a schematic view of a one sided drive system according to the invention for maximum take-up of length elongation of a tangential drive belt.

Referring to FIG. 5, a one-sided drive system for a spinning machine differs from the embodiment shown in FIG. 4 substantially only in that the spinning machine is laid out with only one side. This permits a larger pivoting angle $\alpha$ to be used. In this alternative system, which is laid out for maximum compensation of length elongation of the tangential drive belt, the pivoting angle $\alpha$ can reach values of up to 180°. Other than in the system according to FIG. 4, the biasing means acting on the pivoting lever 53 consists of a cylinder 50 and piston 51 unit which, via a force transmitting element 52 placed around a pivoting segment 52' rigidly connected to the lever 53, exerts a pivoting momentum on the lever 53. In this arrangement also, the lever 52 is rotatably supported on the tensioning roll for tensioning the tangential drive belt. The piston 51 is supplied with a pressurized hydraulic or pneumatic fluid via a valve 54 and a supply duct 55. This alternative construction of the biasing means has an advantage in that the tension force of the tangential drive belt, owing to the fact that the biasing force acting on the lever 53 is constant, is maintained constant independently of the position of the pivoting lever 53 at all times.

Figure 6:
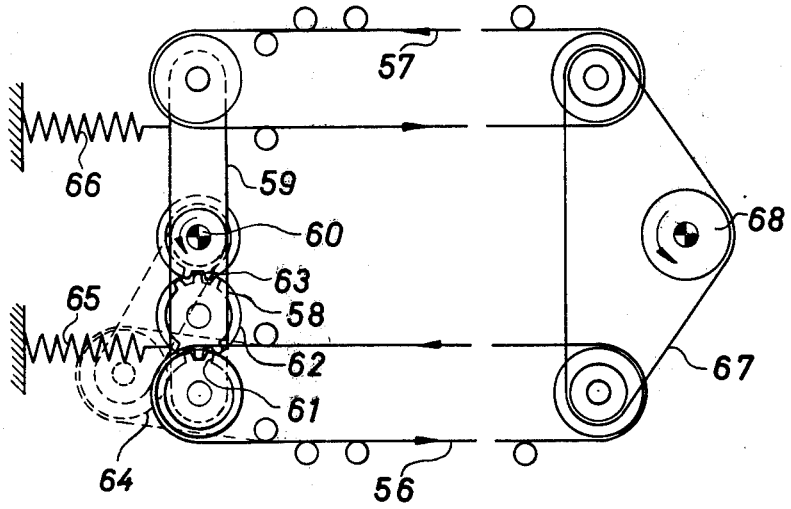
FIG. 6 illustrates a further modified drive system according to the invention.

Referring to FIG. 6, the spinning machine is laid out double-sided, each machine side being equipped with a tangential drive belt 56, 57 respectively. The arrangement differs from the one shown in FIG. 4 in that both pivoting levers 58, 59 no longer are pivotal about two separate pivoting axes, but are pivotally supported about one common pivoting axle 60. The axle 60 is also used for driving additional working elements of the spinning machine, the drive being derived from one of the two tensioning rolls of the two tangential drive belts 56, 57. For this purpose, a gear train consisting of gears 61, 62 and 63 is provided in this system. The gear 61 is rigidly connected with the rotational axle of the tensioning roll 64 of the tangential drive belt, whereas the gear 63 is rigidly connected with the pivoting axle 60. The intermediate gear 62 is rotatably but unshiftably mounted on the lever 58 and meshes with both gears 61 and 63. In this alternative system, both tangential drive belts 56, 57 are jointly driven via an endless belt 67 by a drive pulley 68. The torque momentum required for tensioning the tangential drive belts 56 and 57 is exerted by tension springs 65, 66 which act on the respective levers 58, 59.

Instead of using tension springs, torsion springs or torque bars could be a very suitable means for exerting a torque momentum on the levers 12, 40, 41, 53, 58 and 59. Because of the pivotal arrangement of the tensioning roll, a large elongation of the tangential drive belt can be compensated in a space saving arrangement. That is, the tangential drive belt, particularly in the arrangements in which the belt contactingly surrounds the tensioning roll over an arc of about 180°, can be tensioned by being angled off with respect to the longitudinal direction of the spinning machine. The space required in the longitudinal direction of the spinning machine thus depends only on the small distance of the outermost point of the tangential drive belt.

A further advantage resides in the fact that no slide path with a sliding support is required for the tensioning roll. Instead, a much simpler antifriction bearing support for a pivoting motion can be provided. Thus, maintenance of the spinning machine is simplified as no dust contamination of open sliding guides, and accordingly, no jamming of the tensioning device are possible.

A further advantage resides in that no tensioning device is needed for the drive transmitting means since the distance is fixed between the axes of rotation of the pivot axle and the tensioning roll from which the drive of additional working elements of the machine is derived. Thus, the tangential belt drive of the invention is simpler and less expensive and, mainly, more favorable with respect to maintenance in comparison to the known drive arrangements of such type, which respect a tensioning device.

What is claimed is:

1. A drive system for a spindle frame of a spinning machine having a plurality of spindles arranged in a row, said drive system comprising
- a drive roll,
- a tensioning roll,
- a tangential drive belt tensioned between said drive roll and said tensioning roll for engaging and driving the spindles,
- a first axle secured to said tensioning roll for rotation therewith about a first axis,
- a second axle rotatably mounted about a fixed second axis,
- a lever journalled on said first axle and said second axle,
- means secured to said lever for biasing said lever to pivot about said second axis in a plane parallel to said tangential drive belt,
- drive transmitting means disposed between said first and second axles for rotating said second axle off said first axle, and
- a drive means interconnected to said second axle for driving additional working elements of the spinning machine.

2. A drive system as set forth in claim 1 wherein said lever is pivotal relative to said second axis over a pivoting angle of 180°.

3. A drive system as set forth in claim 1 wherein said drive transmitting means is an endless belt.

4. A drive system as set forth in claim 1 wherein said drive transmitting means includes a plurality of meshing gears rotatably supported in said lever on fixed axes.

5. A drive system as set forth in claim 1 wherein two mutually parallel rows of a plurality of spindles are positioned along said tangential drive belt.

6. A drive system as set forth in claim 5 wherein said lever is pivotal relative to said second axis over a pivoting angle of from zero to 90°.

7. A drive system as set forth in claim 1 wherein said biasing means includes a spring.

8. A drive system as set forth in claim 1 wherein said biasing means includes a cylinder and piston unit.

9. In combination with a spindle frame having two rows of spindles, a drive system for each said row of spindles, each said drive system comprising
- a drive roll,
- a tensioning roll,
- a tangential drive belt tensioned between said drive roll and said tensioning roll for engaging and driving the spindles,
- a first axle secured to said tensioning roll for rotation therewith about a first axis,
- a second axle rotatably mounted about a fixed second axis,
- a lever journalled on said first axle and said second axle,
- means secured to said lever for biasing said lever to pivot about said second axis in a plane parallel to said tangential drive belt, and
- a drive transmitting means disposed between said second axle and first axle for rotating said second axle off said first axle.

10. The combination as set forth in claim 9 wherein said second axle is common to said first axle and said lever of each drive system.

11. The combination as set forth in claim 9 wherein said lever of each drive system is mirror-symmetric to said lever of the other drive system.

12. A drive system for a spindle frame of a spinning machine having a plurality of spindles arranged in a row, said drive system comprising a drive roll, a tensioning roll, a tangential drive belt tensioning between said drive roll and said tensioning roll for engaging and driving the spindles, a first axle secured to said tensioning roll for rotation therewith about a first axis, a second axle rotatably mounted about a fixed second axis, a lever journalled on said first axle and said second axle, means secured to said lever for biasing said lever to pivot about said second axis in a plane parallel to said tangential drive belt, and drive transmitting means disposed between said first and second axles for rotating said second axle off said first axle.

* * * * *

UNITED STATES PATENT AND TRADEMARK OFFICE

CERTIFICATE OF CORRECTION

PATENT NO. : 4,051,656

DATED : October 4, 1977

INVENTOR(S) : Heinz Burri, Richard Burri

It is certified that error appears in the above-identified patent and that said Letters Patent are hereby corrected as shown below:

Column 3, line 31 Change "Figs. 1 and 3" to --Figs. 1 to 3--.

Column 3, line 47 eliminate l"drive" so that it reads -- tangential drive belt--

Column 5, line 66 change "with respect a tensioning" to --which require a tensioning--

Claim 9, line 61, after "and" should read --said--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*